US005110416A

United States Patent [19]

Linsuri et al.

[11] Patent Number: 5,110,416

[45] Date of Patent: May 5, 1992

[54] TURBULENCE GENERATOR IN THE HEADBOX OF A PAPERMAKING MACHINE

[75] Inventors: Ari Linsuri; Michael H. Odell, both of Jyväskylä , Finland

[73] Assignee: Valmet Paper Machinery Inc., Finland

[21] Appl. No.: 532,394

[22] Filed: Jun. 1, 1990

[30] Foreign Application Priority Data

Jun. 2, 1989 [FI] Finland ..... 892709

[51] Int. Cl.[5] ..... D21F 1/06

[52] U.S. Cl. ..... 162/343; 162/336; 162/340; 162/339; 162/344

[58] Field of Search ..... 162/343, 336, 340, 339, 162/344

[56] References Cited

U.S. PATENT DOCUMENTS

| | | | |
|---|---|---|---|
| 3,528,882 | 6/1967 | Notbohm | 162/336 |
| 4,455,197 | 6/1984 | Croteau et al. | 162/343 |
| 4,687,548 | 8/1987 | Iimoniemi et al. | 162/336 |

*Primary Examiner*—Karen M. Hastings
*Assistant Examiner*—Brenda Lamb
*Attorney, Agent, or Firm*—Steinberg & Raskin

[57] ABSTRACT

A turbulence generator (20) in the headbox of a paper making machine which produces internal microturbulence in the pulp suspension flow (F), whereby the homogeneity of the flow is improved. The turbulence generator (20) comprises a system of turbulence tubes, which consists of a number of turbulence tubes (22) placed one above the other and side by side. These tubes start at the inlet side of the turbulence generator (20) having thereat a substantially circular cross-section, being gradually and smoothly, in the flow direction, converted to a rectangular cell structure with planar sides. The cell structure (30) at the outlet side (23) of the turbulence generator (20) consists of an overlapping cell system, wherein there are at least two inclined middle cell rows (31, 32; 31*a*, 31*b*, 32*a*, 32*b*) placed one above the other, in which cell rows the cells have rectangular cross-sections. The cells have a shorter planar side (X) and a longer planar side (Y). The long sides (Y) are, relative to one another, and the short sides (X) are, relative to one another, in the middle cell rows (31, 32; 31*a*, 31*b*, 32*a*, 32*b*) placed one above the other, positioned perpendicularly to one another and at an angle of about 45° relative to the horizontal and the vertical planes. The cell structure includes peripheral cell rows (33*a*, 33*b*) placed above and underneath the middle cell rows (31, 32; 31*a*, 31*b*, 32*a*, 32*b*).

13 Claims, 3 Drawing Sheets

FIG.1
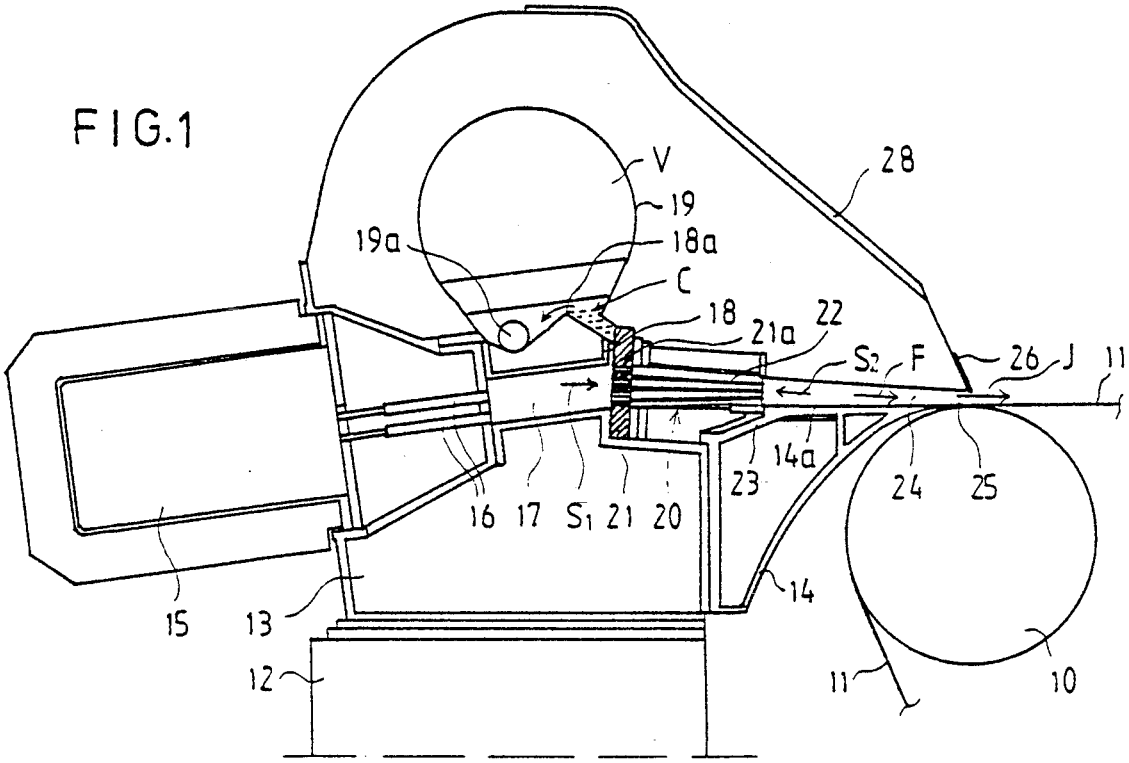
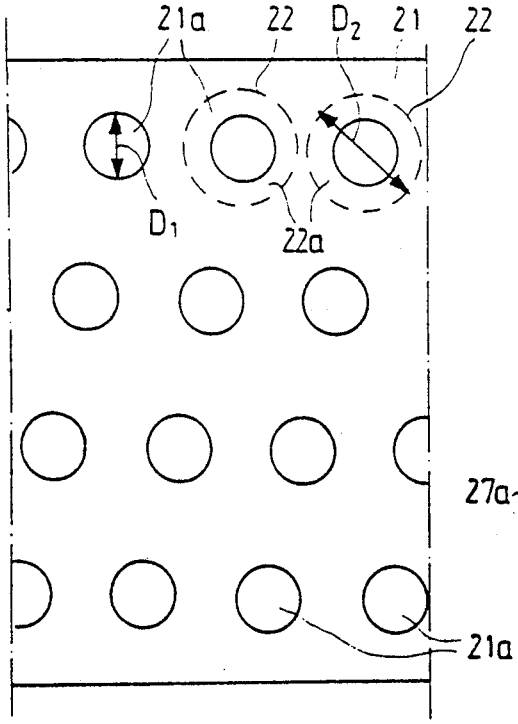
FIG.2
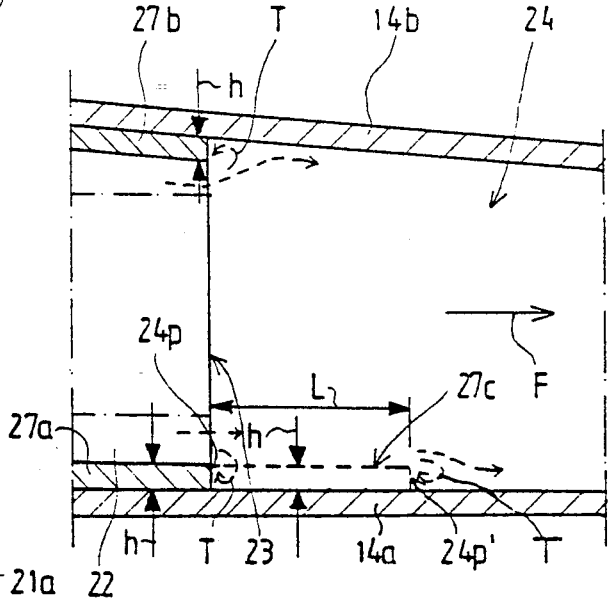
FIG. 3

TURBULENCE GENERATOR IN THE HEADBOX OF A PAPERMAKING MACHINE

BACKGROUND OF THE INVENTION

The invention concerns a turbulence generator in the headbox of a paper or paperboard making machine, by whose means internal microturbulence is produced in the pulp suspension flow, whereby the homogeneity of the flow is improved, the turbulence generator comprising a system of turbulence tubes, which consists of a number of turbulence tubes placed one above the other and side by side, these tubes extending from an inlet side of said turbulence generator to an outlet side thereof and having at the inlet side a substantially circular cross-section, and being gradually and smoothly, in the flow direction, converted to a cell structure with planar sides, in which cellular structure, with the exception of any lateral ducts, the cross-sectional flow areas of each cell are substantially equal in size, as compared with one another, and which cell structure is substantially fully occupied at the outlet side of the turbulence generator.

As is known in the prior art, in various headboxes in paper machines, turbulence generators are used, in which the pulp suspension flow is distributed into turbulence tubes to make component flows, which are discharged at the outlet side of the turbulence generator into a discharge duct that becomes narrower in a wedge-shaped manner. Out of the discharge opening of the discharge duct, the pulp suspension jet is discharged onto a forming wire or into a forming gap defined by two opposite wires.

A type of headbox which is known from the prior art and is commonly used has a turbulence generator wherein there is first a perforated plate in the flow direction of the pulp suspension. This perforated plate comprises a large number of flow holes placed in a number of rows placed one above the other, these flow holes opening into turbulence tubes which are wider than the diameters of the holes. These turbulence tubes begin having a circular cross section coaxial with the flow holes in the perforated plates and turn somewhat towards one another in the vertical plane. By the time that the outlet said of the turbulence generator is reached, the turbulence tubes have changed smoothly to tubes of substantially square cross-section, so that they have vertical walls and horizontal walls. The tubes placed vertically one above the other are staggered relative to one another in such a way that the vertical walls of tubes placed one above the other have a certain angular shift relative to one another in the lateral direction.

It has been a drawback in prior art headboxes, for example in those described hereinbefore but also in other headboxes, that when using these headboxes striated paper is often produced wherein streaks occur in the transverse direction, generally with the same spacing as the spacing of the tubes of the turbulence generator. Moreover, by means of measurement, it has been possible to ascertain that, in the discharge duct in the headbox, variation occurs in the turbulence intensity and velocity profiles with the same tube spacing. This variation occurs in all of the layers of headbox flow placed one above the other, and this variation is at a maximum on and near the faces of the lower and upper walls of the discharge duct.

SUMMARY OF THE INVENTION

An object of the present invention is construction of a turbulence generator as well as of its system of turbulence tubes so as to produce internal microturbulence in the pulp suspension flow which eliminates the above mentioned drawbacks of the prior art.

More specifically, when prior art turbulence generators have been used, problems have also occurred in the flow regulation of the headbox, in particular with regard to providing a sufficiently stable headbox. When prior art flow regulating structures have been used, stability of the operation of the headbox and avoidance of the formation of streaks in the flow have been objectives which contradict to one another.

Another object of the present invention is to provide a novel turbulence generator and a construction of turbulence tubes therefor by whose means it is possible to eliminate the majority of the problems discussed hereinbefore since it has not been possible to act efficiently by means of prior art methods and prior-art flow-regulating structures of the invention to improve the lateral areas of the flow by making the vertical walls shorter and by improving the mixing of layers with each other by means of a tube pattern of a new type.

It is an additional object of the invention to provide a turbulence generator wherein tight angular turns in the system of turbulence tubes are avoided, these angles generally causing contamination of the headbox.

It is a further object of the invention to provide a turbulence generator for the headbox of a paper machine at whose outlet side the component flows discharged out of the systems of turbulence tubes into the discharge duct can be distributed evenly relative to one another but which overlap each other in varying directions so that most of the aforesaid problem of streaking is avoided.

Also, it is a further object of the present invention to provide a novel solution for the headbox flow and for avoiding streaks in paper or paperboard made therefrom, while, at the same time, maintaining good stability in the headbox.

With a view to achieving the objectives stated above and those that become apparent from the following description, the invention is mainly characterized in that the cell structure at the outlet side of the turbulence generator consists of an overlapping cell system, wherein there are at least two or more inclined middle cell rows placed one above the other, in which cell rows the cells have rectangular cross-sections such that they have a first, shorter side and a second, substantially longer planar side, the long sides being, relative to one another, and said short sides being, relative to one another, in the middle cell rows placed one above the other, positioned perpendicularly to one another and at an angle of about 45° relative to the horizontal and the vertical planes, and that the cell structure includes peripheral cell rows placed above and underneath the middle cell rows, the cells in the peripheral cell rows being defined by vertical sides terminating in the edges between adjoining middle cells, by the shorter sides of the adjoining middle cells, and by the upper and lower horizontal walls of the cell system.

In the present invention, the tubes of rectangular section in the turbulence generator have been inclined, in the rows of tubes placed one above the other, in opposite directions such that between the tube corners placed one above the other there is always a wall inclined relative to the vertical plane. The vertical walls in the topmost row and lowermost row of tubes are also placed at different locations. The smallest angle in the cross-section of the cell system is a right angle, this construction preventing contamination from occurring.

The flows discharged out of the turbulence tubes (these tubes being placed in accordance with the invention) into the discharge duct can be made to overlap each other regularly but in varying directions in a manner not shown in the prior art, so that the formation of streaks in the headbox flow in its different layers and the corresponding formation of sreaks in the paper produced by means of the headbox can be avoided almost entirely .

In connection with the present invention, between the outlet side of the turbulence generator an the inlet side of the discharge duct, it is has been found advantageously to use a transverse step or steps, at which steps the cross-sectional flow area is stepwise increased, whereby additional turbulence is produced in connection with the upper and/or lower wall of the discharge duct.

BRIEF DESCRIPTION OF THE DRAWINGS

In the following, the invention will be described in detail with reference to some preferred exemplifying embodiments of the invention illustrated in the Figures in the accompanying drawings, the invention being not strictly confined to the details of these embodiments.

FIG. 1 is a vertical sectional view in the machine flow direction of a headbox construction in connection with which it is advantageous to apply a turbulence generator in accordance with the invention.

FIG. 2 shows a headbox turbulence generator in accordance with FIG. 1 viewed from the direction $S_1$ indicated in FIG. 1.

FIG. 3 is a vertical sectional view in the machine direction of turbulence-step construction between the system of turbulence tubes in a turbulence generator and the discharge duct, said construction being advantageous for use with a system of turbulence tubes in accordance with the invention.

DESCRIPTION OF THE PREFERRED EMBODIMENTS

Figure 4:
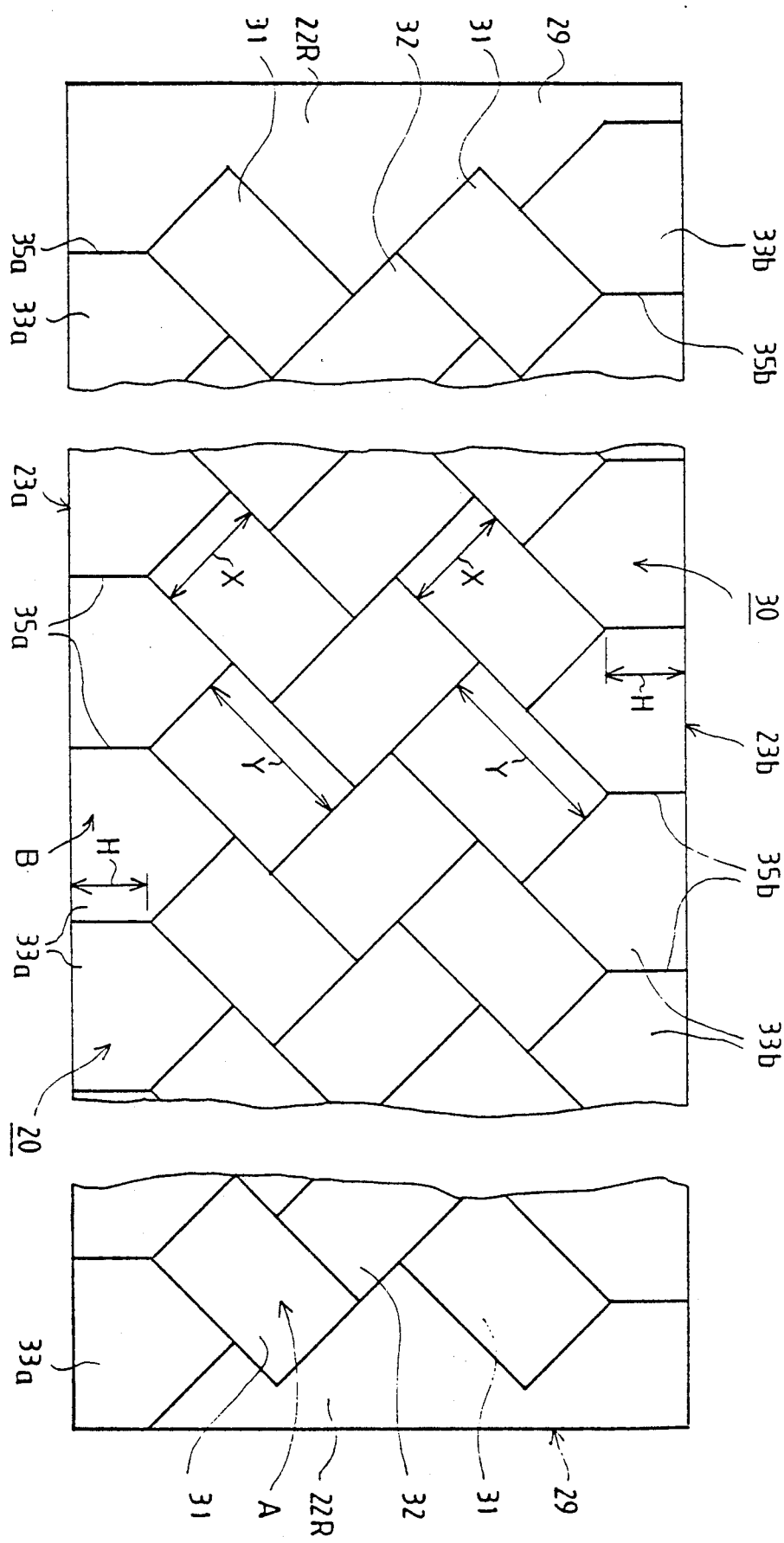
FIG. 4 shows a cell arrangement in accordance with a particularly advantageous embodiment of the turbulence generator in accordance with the invention as viewed from the direction $S_1$indicated in FIG. 1.

The headbox construction shown in FIG. 1 is primarily known in the prior art, and it will be described herein to give further background information with regard to the invention. The pulp suspension jet J from the headbox is fed onto the forming wire 11 running over the breast roll 10. The headbox comprises a footing or base construction 12, on which there is a lower-frame beam 13. A lower-lip beam 14 is attached to the front wall of the beam 13, the upper wall **14*a* of said lower-lip beam 14 defining the discharge duct 24 at its top side, said discharge duct 24 terminating in the discharge opening 25. From above, the discharge duct 24 is defined by an upper-lip wall 14*b*, which is connected with shield constructions 28. Through the discharge opening 25, the pulp suspension jet J is fed onto the wire 11 or into a gap between wires. The discharge opening 25 is defined and regulated by an upper-lip plate 26**.

The pulp suspension is passed into the headbox by means of a transverse distribution beam 15, from which the flows are distributed into a number of distribution tubes 16 in the machine direction. Out of the distribution tubes 16, the pulp suspension flow enters into a stilling chamber 17, at which, above the outlet side of the stilling chamber, there is a duct 18, which opens into the stilling chamber placed above. In the stilling chamber, there is an air space V, which acts as an attenuator of pressure variations. In connection with the duct 18, there is a dam **18*a*, which is followed by an overflow 19*a*. The dam 18*a*** sets the level of the surface C of the pulp suspension.

Outflow from the stilling chamber 17 is followed by a turbulence generator 20 in accordance with the invention, which comprises, in the flow direction, first a perforated plate 21 provided with four rows of flow holes **21*a*, the rows being placed one above the other. The locations and spacings of the holes 21*a* are shown from FIG. 2. Each hole 21*a* opens into a turbulence tube 22 in the turbulence generator 20, these tubes 22 starting coaxially with their respective holes 21*a*. The diameter $D_2$ of the tubes 22 is larger than the diameter $D_1$ of the holes 21*a*. The ratio $D_2/D_1$ of the diameters $D_2$ and $D_1$ is preferably of $D_2/D_1$ varying from 2/1 to 1/1. Thus, between the holes 21*a* and the tubes 22, there is a step 22*a*** of 90°.

Figure 5:
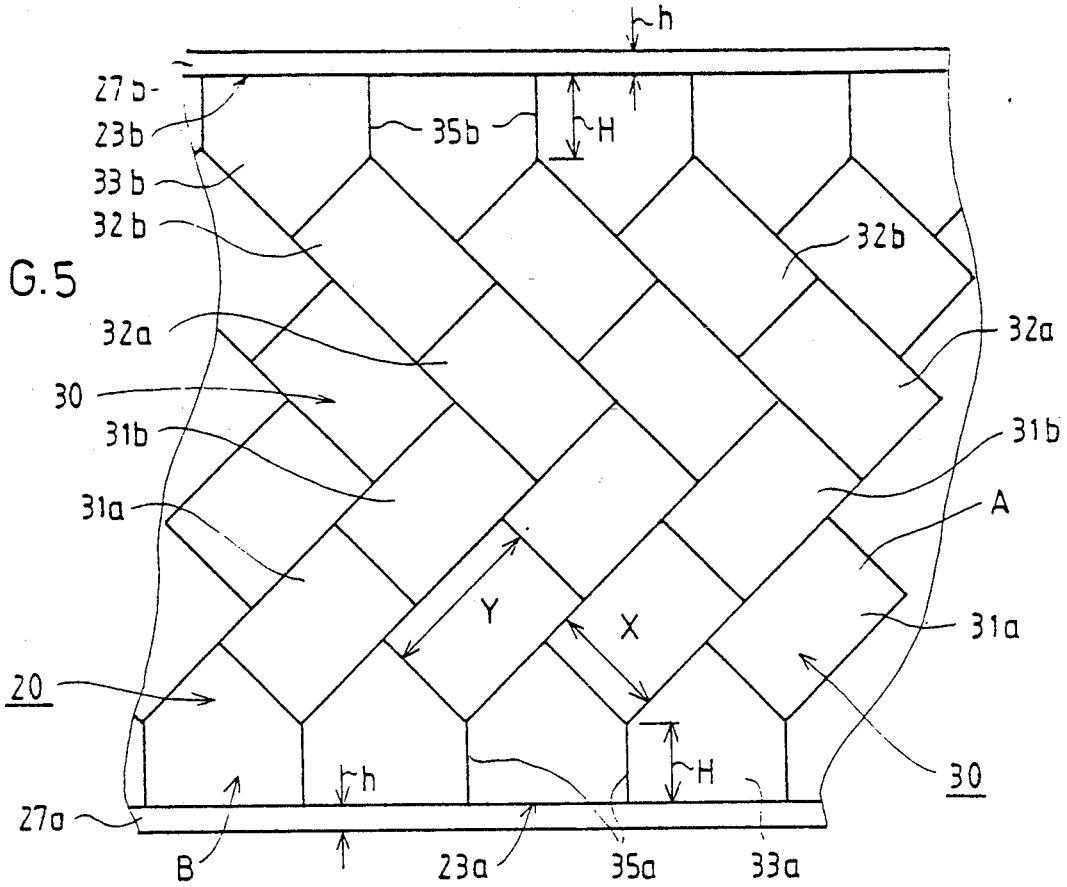
FIG. 5 shows a second cell arrangement in a turbulence generator in accordance with the invention in a way corresponding to FIG. 4.
Figure 6:
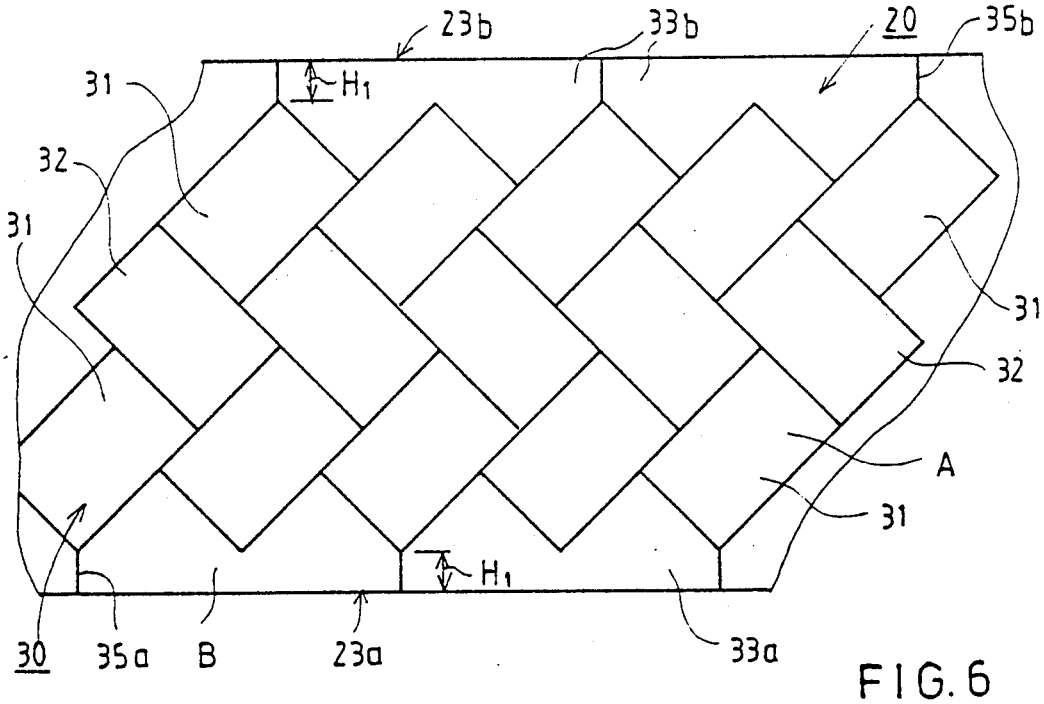
FIG. 6 shows a third cell arrangement in accordance with the invention in a way corresponding to FIGS. 4 and 5.

After their respective initial portions which run parallel to one another, the turbulence tubes 22 turn in the vertical plane slightly towards each other, and their flow cross-sections are changed smoothly and gradually from a circular cross-section to a rectangular cross-section, such that, at the outlet edge 23 of the turbulence generator 20, a fully occupied cell structure shown in FIGS. 4, 5 and 6 is formed. At the outlet side 23 of the turbulence generator 20, the entire flow cross-sectional area consists of cells, with the sole exception of the wall thickness of the turbulence tubes 22. Out of the cell construction at the outlet side 23 of the turbulence generator 20, the component flows in the pipes are discharged, whereupon they scatter and overlap each other into the discharge duct 24, from which the flow goes on in the direction of the arrow F into the discharge opening 25.

As is shown in FIG. 4, the cell construction 30 at the outlet side 23 of the turbulence generator 20 comprises three rows 31, 32, placed one above the other, of rectangular tubes inclined at an angle of 45° and interlocking each other in a mosaic pattern. The cell rows **33*a* and 33*b* defined by the respective lower and upper walls 23*a* and 23*b* of the discharge duct in the turbulence generator 20 comprise vertical walls 35*a*, 35*b*, which are, in the lateral cells placed one above the other, not in the same vertical plane but have a suitable plase shift. In the middle rows 31, 32, the ratio of the longer sides Y of the tubes to the shorter sides X is Y/X varies from 3/1 to 1/1. In an advantageous embodiment, Y/X=3/2. In FIG. 4, the lateral ducts 22R defined by the vertical side walls 29 of the turbulence generator and of the discharge duct 24 are shaped as polygons. Into these lateral ducts 22R**, it is possible to pass flows separately in accordance with the principles and constructions thereto that are described in the Applicant's FI Patent Applications Nos. 844276 and 850638. In this way it is possible to control the fiber orientation and its distortion.

FIG. 5 shows a second cell-system construction 30, wherein there are two cell rows 31*a*, 31*b* and 32*a*, 32*b* placed one above the other and inclined by 45° relative to the horizontal and vertical planes and, above and underneath said cell rows, wedge-shaped peripheral cell rows 33*a*, 33*b* similar to those described above. In FIG. 5 as well, the ratio of the longer side Y to the shorter side X in the various cells is $Y/X=1.5$.

FIG. 5 shows the steps 27*a* placed between the cell system 30 and the inlet side of the discharge duct 24, these steps enlarging the cross-sectional flow area, and the height of these steps being denoted with h. This step construction is also seen in FIG. 3, wherein the upper and lower steps are denoted with the reference numeral 24*p*. In connection with the step 24*p*, in the area T, turbulence is produced, which improves the microturbulence level for the flow in connection with the lower and upper walls 14*a*, 14*b* of the discharge duct 24. Moreover, in FIG. 3, a possible extension plate 27*c* is illustrated by means of a dashed line, the length of this plate being denoted with L. This extension plate 27*c* can be used if necessary, and in its connection a step 24*p'* is formed. The height h of the step 24*p'* is, as a rule, in the range of $h=0$ to 6 mm, and the length L of the extension part 27*c* is $L=0$ to 200 mm. An optimal turbulence level has been reached when $h=4$ mm and $L=0$ to 100 mm.

FIG. 6 shows a third embodiment of the invention, wherein, in a construction corresponding to FIG. 4, there are three rows 31, 32 of cells placed one above the other and inclined at an angle of 45°. The upper and lower rows 33*a*, 33*b* of peripheral cells are, differing from FIG. 4, provided with two ridges, being defined by three adjoining cells 31.

Moveover, it is characteristic of the set of turbulence tubes in accordance with the invention and of the particular cell constructions at its outlet side that the respective cross-sectional flow areas $A=X\times Y$ of all of the cells are equally large. Moreover, it is characteristic of the cell construction that the cross-sectional flow areas B of the upper and lower peripheral cells 33*a*, 33*b* are substantially equally large as the cross-sectional areas A of said middle cells ($A=B$). When this equality $A=B$ is taken into account in FIG. 4, the height of the vertical walls 35*a*, 35*b* of the lateral cells is $H=(0.5 \text{ to } 1.0)\times X$. In a corresponding way, in FIG. 6, the height of the vertical walls 35*a*, 35*b* is $H_1=(0.2 \text{ to } 0.5)\times X$. The areas A and B of these cells do not always have to be necessarily exactly equally large, but the difference in size between them can be, at the maximum, about 5%. This maximal different of about 5% is most appropriately also applicable between the different tubes 22 and cells with respect to their flow resistances.

With regard to the preferred embodiment of FIG. 14, the cross-sectional flow areas of both of the lateral ducts 22R are several times larger than the cross-sectional flow areas A and B. Into each lateral duct 22R, for example, three flow holes 21*a* in the perforated plate 21 are opened.

Details of the present invention may easily vary within the scope of the inventive concepts set forth above, which have been presented by way of example only. Therefore, the preceding description of the present invention is merely exemplary, and is not intended to limit the scope thereof in any way.

What is claimed is:

1. A turbulence generator in the headbox of a paper machine, said turbulence generator producing microturbulence in a paper pulp suspension flowing therethrough such that homogeneity of said paper pulp flow is improved, said a plurality or said turbulence tubes spaced apart from each other at substantially the same vertical level; said plurality of turbulence tubes each extending from an inlet side of said turbulence generator to an outlet of said turbulence generator and each said turbulence tube having a substantially circular cross-sectional area at said inlet side and each said tube having a smoothly and gradually changing cross-sectional area such that, at said outlet side of said turbulence generator, each tube comprises a plurality of planar sides such that said outlet side forms a cell structure comprising individual ones of said tubes abutting each other so as to form an overlapping cell system wherein there are two or more middle cell rows, each said middle cell row comprising a plurality of cells each having sides inclined from both the vertical and horizontal planes, said cells of each said middle cell row being substantially horizontal with each other and having a rectangular cross-sectional area with shorter planar sides and longer planar sides, and a cell structure comprising a plurality of peripheral cell rows placed respectively above and below said middle cells rows, each said peripheral cell row comprising a plurality of peripheral cells each being defined by vertical sides which terminate at a corner of adjacent cells in one of said middle cell rows, and by said shorter planar sides of adjoining cells of said middle cell rows, said plurality of peripheral cells having a substantially pentagonal shape or having a two-ridged structure defined by the shorter planar sides and the longer planar sides of three adjoining middle cells and having vertical sides; and said cell structure comprising upper and lower horizontal walls which further define said cells of said peripheral cell row;

further comprising said turbulence generator having one or more lateral ducts;

wherein said cell structure substantially fully occupies said outlet side of said turbulence generator; and wherein said shorter planar sides and said longer planar sides of said cells within said middle cell rows are each at an angle of about 45 degrees relative to the horizontal and vertical planes.

2. The turbulence generator of claim 1, wherein said lateral ducts each comprise a vertical wall outside said turbulence generator and defined on its inside by outside walls of cells within said cell structure.

3. The turbulence generator of claim 2, further comprising said one or more lateral ducts each having a cross-sectional area substantially larger than the cross-sectional area of said cells of said cell structure.

4. The turbulence generator of claim 1, wherein said plurality of peripheral cells are of said two-ridged structure and have a configuration wherein said vertical sides have a height which is 0.2 to 0.5 times that of said shorter sides.

5. The turbulence generator of claim 1, wherein said middle cell rows overlap each other and said shorter planar sides of adjacent cells of adjoining middle rows are in contact with each other throughout their length.

6. The turbulence generator of claim 1, wherein the cross-sectional flow areas of said cells of said middle cell rows and said cells of said peripheral cell rows are substantially equal.

7. The turbulence generator of claim 1, wherein the flow resistances of said cells of said middle cell rows and said cells of said peripheral cell rows are substantially equal.

8. The turbulence generator of claim 1, further comprising a discharge duct appended to said outlet side, and a step portion appended to said discharge duct, said step portion having a substantially larger cross-sectional area than said tubes whereby the cross-sectional flow area increases substantially at said discharge duct outlet side.

9. The turbulence generator of claim 8, wherein said step portion comprises a extension plate extending into said discharge duct and at its other end extending a distance from said discharge duct.

10. The turbulence generator of claim 1, further comprising a perforated plate connected to said turbulence tubes at said inlet side, said perforated plate having a series of circular flow holes placed in rows one above the other and side by side in each row, said holes being coaxial with said turbulence tubes at said inlet side of said turbulence generator.

11. The turbulence generator of claim 10, wherein the ratio of the diameter of the turbulence tubes to the diameter of the flow holes ranges from 1/1 to 2/1.

12. The turbulence generator of claim 11, further comprising a stilling chamber connected to said perforated plate, an attenuation tank situated above and communicating with said stilling chamber, and a dam placed in said tank determining the level of said paper pulp suspension therein.

13. The turbulence generator of claim 12, further comprising a set of distribution tubes connected to an input of said stilling chamber and a distribution beam connected to respective inputs of said distribution tubes.

* * * * *